US006158151A

United States Patent [19]

Won

[11] Patent Number: 6,158,151

[45] **Date of Patent: *Dec. 12, 2000**

[54] GOLF SHOES

[76] Inventor: Jong-Pil Won, 60-1304, 5th Hyundai Apt., 161-1 Garak-Dong, Songpa-ku, Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 09/186,590

[22] Filed: Nov. 5, 1998

[30] Foreign Application Priority Data

Jul. 29, 1998 [KR] Rep. of Korea ..... 98-30595
Oct. 1, 1998 [KR] Rep. of Korea ..... 98-41409

[51] Int. Cl.[7] ..... A43B 5/00; A43B 13/14

[52] U.S. Cl. ..... 36/127; 36/103; 36/25 R

[58] Field of Search ..... 36/103, 127, 25 R, 36/31

[56] References Cited

U.S. PATENT DOCUMENTS

| | | |
|---|---|---|
| 2,847,769 | 8/1958 | Schlesinger . |
| 3,964,181 | 6/1976 | Holcombe, Jr. . |
| 4,056,106 | 11/1977 | Salvatore . |
| 4,149,324 | 4/1979 | Lesser et al. . |
| 4,364,189 | 12/1982 | Bates . |
| 4,682,425 | 7/1987 | Simmons . |
| 4,685,227 | 8/1987 | Simmons . |
| 4,754,561 | 7/1988 | Dufour . |
| 4,864,739 | 9/1989 | Maestri . |
| 4,875,683 | 10/1989 | Wellman et al. . |
| 5,265,354 | 11/1993 | Aliano, Jr. . |
| 5,327,663 | 7/1994 | Pryce . |
| 5,752,330 | 5/1998 | Snabb . |

FOREIGN PATENT DOCUMENTS

| | | |
|---|---|---|
| 62-270102 | 11/1987 | Japan . |
| 404073001 | 3/1992 | Japan . |
| 405277001 | 10/1993 | Japan . |
| 3047884 | 2/1998 | Japan . |
| 1676582 | 9/1991 | U.S.S.R. . |
| 9111124 | 8/1991 | WIPO . |

*Primary Examiner*—Ted Kavanaugh

[57] ABSTRACT

This invention is related to a golf shoe that naturally shifts the center of weight into a heel portion and cause smooth swing. The golf shoes according to this invention comprises a sole having a heel portion (30), a toe portion (34) formed continuously forwardly from the heel portion (30) and an intermediate metatarsal portion (32) formed between the heel portion (30) and the toe portion (34), wherein the toe portion (34) is angled 1~5° upward from a horizontal line taking the intermediate metatarsal portion (32) as pivot point and the heel portion is angled −7~7° from the horizontal line taking the intermediate metatarsal portion as pivot point.

4 Claims, 5 Drawing Sheets

GOLF SHOES

FIELD OF THE INVENTION

This invention relates to golf shoes and, more particularly, to golf shoes which are helpful in naturally transferring the center of weight to a heel portion without a user having to think about weight transfer during swing.

DESCRIPTION OF THE RELATED ART

Golf is a sport which involves setting a golf ball into a hole through swing, and keeping a fine body posture during the swing is necessary in this sport.

As such, as long as a golfer maintains his balance and transfers his center of weight from inside to outside of an intermediate metatarsal portion and to a heel portion while he swing to hit a ball on the grass, he can perform a stabilized swing.

A golfer hits the ball while he rotates his shoulder and waist using his backbone as an axis in the game of golf. Thus it needs a proper and comfortable address posture. However, commonly, a golfer has to think about maintaining his balance during a swing which would cause distraction and thus bad results.

On the other hands, a golfer would lose his address posture and cannot maintain his balance if he swings without thinking about maintaining balance. Both of the above-mentioned cases would cause bad results.

Therefore, golf shoes, which are helpful in maintaining balance, are needed in order that a golfer can swing naturally without causing the above-mentioned problems. It has been objects of researches to solve the above-mentioned problems. However, that has been not completed result. Generally, golf is played on grass. Golf shoes are indispensable in golf and golf shoes having resistance against slipping are needed.

It can be said that the emphases on the improvement of golf shoes have mainly been to prevent golfer from slipping from the ground. Thus, golf shoes have been improved significantly with respect to preventing slipping.

FIG. 6 is a cross sectional view illustrating the sole of a conventional golf shoes. As shown in FIG. 6, conventional golf shoes have plural spikes (4) on their soles (6), and the sole (6) is divided into a heel portion (2) and a toe portion (8). The bottom surface of the heel portion and the bottom surface (12) of the toe portion (8) are almost in parallel or the bottom surface (12) of the toe portion (8) is formed to be a little bit lower than the bottom surface of the heel portion (2).

As shown in FIG. 6, it is known that the upper surface of an intermediate metatarsal portion (10) of the toe portion of the sole is formed to be lower than that of the heel portion.

That is, as shown in FIG. 7, the heel portion of a conventional golf shoe is always above 0° line of the intermediate metatarsal portion and the toe portion is about 11 mm above the surface of the ground.

In case of conventional golf shoes, made in the above-mentioned manner, a golfer has to place his center of weight in the heel portion in address posture for swing so that he can maintain his balance and keep his posture stable during or after a swing.

When wearing the conventional golf shoes as shown in FIG. 6. a golfer tries to put the center of his weight on the heel portion of the golf shoes to maintain his balance since the shoes are formed such that the heel portion, accommodating the heel of a foot, is gradually declined toward the upper surface (10) of the intermediate metatarsal portion.

Because the intermediate metatarsal portion is formed to be lower position than the heel portion, the golfer has to swing after adjusting his posture for proper and convenient address posture, thereby causing unnatural swing and difficulties in maintaining excellent rhyme of swing.

The golfer cannot hit the ball accurately on the grass if he swings in an improper address stance and even though he manages to address, the addressed ball would be far off target in the front and the strength of a stroke would be reduced.

To resolve the above-described problems, the applicant of the present invention filed a patent application No. 98-30595 on Jul. 29, 1998. FIG. 1 is a cross sectional view illustrating the sole of the earlier filed invention by this applicant.

As shown FIG. 1, when the applicant uses golf shoes that were made according to above mentioned application, problems are detected on the intermediate metatarsal portion which accommodates the front of a foot during both walking and addressing, since the upper surface (28) of the toe portion (24) is tilted downwardly in the range of 1~25° from the reference line of upper surface (21) of the heel portion (22) and when a golfer puts it on, toe portion has a downward slope of 1~25° from the heel portion, That is to say, because the value of the downward slope from the heel portion (22) to the toe portion is linear, the golf shoes do not provide stability and convenience while addressing or walking.

However it should be noted that the invention described in FIG. 1 is not a prior art.

SUMMARY OF THE INVENTION

It is therefore an object of the present invention to improve the above problems of the conventional golf shoes. An object of the present invention is to provide golf shoes helpful in smoothly swing without a golfer having to think about weight transfer by smoothly placing the center of body weight on the heel portion.

To accomplish the above object, a golf shoe according to the present invention comprises a heel portion and a toe portion extended continuously forwardly from the heel portion, and a sole on which an intermediate metatarsal portion being formed between said heel portion and toe portion, wherein said toe portion is tilted 1~5° upwardly from a horizontal line taking said intermediate metatarsal portion as pivot point, more preferable, substantially 4°, and said heel portion is tilted −7~7° from the horizontal line taking said intermediate metatarsal portion as pivot point. It is preferred that said heel portion is tilted −5~5° and more preferable, substantially 0°.

When a golfer wears the golf shoes according to the present invention having the angle between the heel portion and horizontal line of −7~7°, and an angle between the toe portion and horizontal line of 1~5°, the golfer can maintain comfortable stance without considering the center of weight. Because the toe portion is higher than the heel portion, the golfer can straighten up his back. Therefore unstable weight transfer is prevented while addressing and swing, it is shown that the golf shoes according to the present invention are excellent in maintaining the proper balance of the golfer. All golfers from beginners to professionals can have proper and comfortable address stance. The golf shoes are also helpful in enhancing accuracy and average flying distances (about 20 yards).

Golf shoes, according to the present invention, are helpful in strengthening the lower part of body and health because these shoes are help a golfer to maintain a proper posture while walking.

BRIEF DESCRIPTION OF THE DRAWINGS

The above-mentioned golf shoes of the present invention will be explained in detail with reference to the attached figures.

DESCRIPTION OF THE PREFERRED EMBODIMENT

Figure 1:
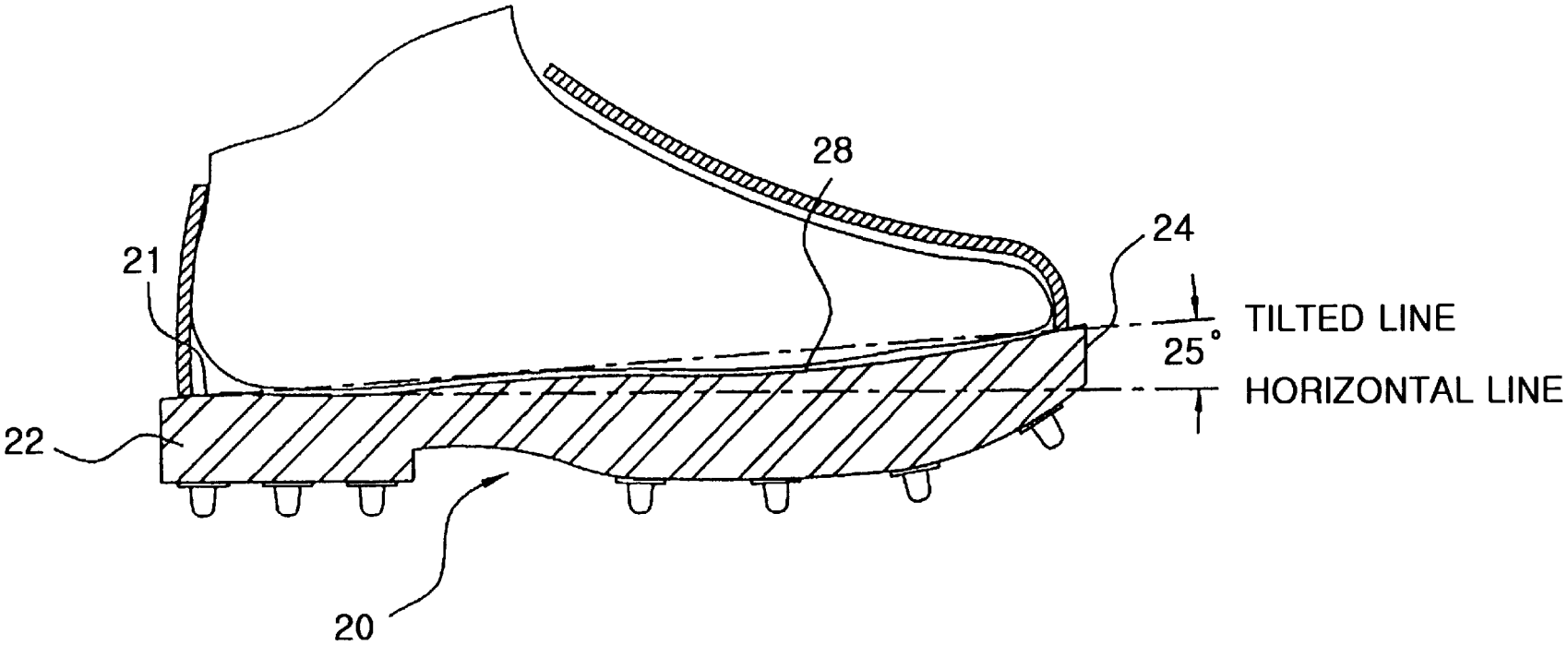
FIG. 1 is a cross sectional view illustrating the sole of the earlier filed invention by this applicant.
Figure 2:
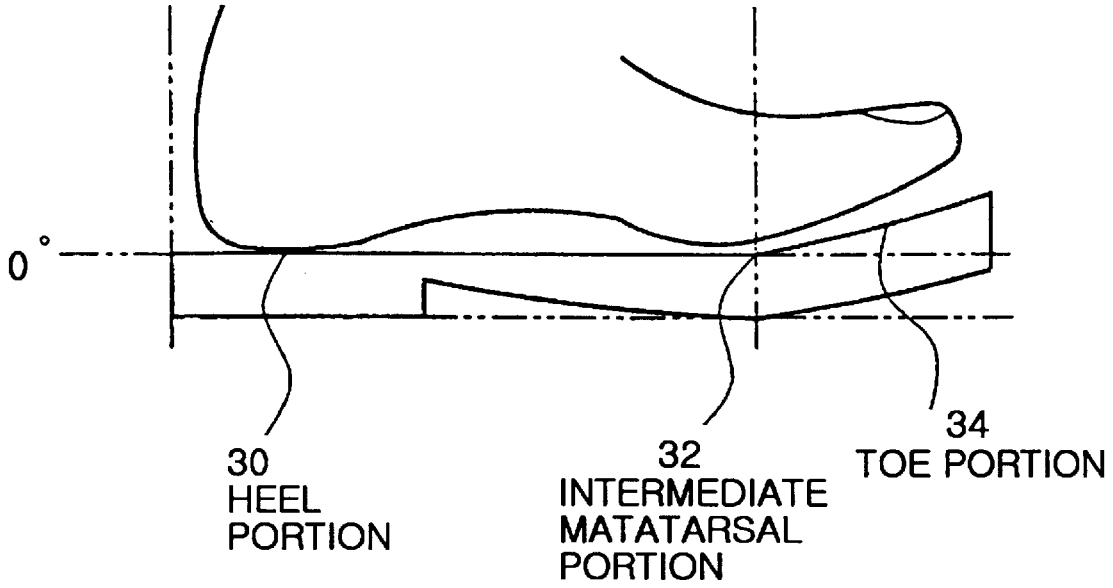
FIG. 2 to FIG. 4 are cross sectional views illustrating the tilted angle of the sole according to the present invention.
Figure 3:
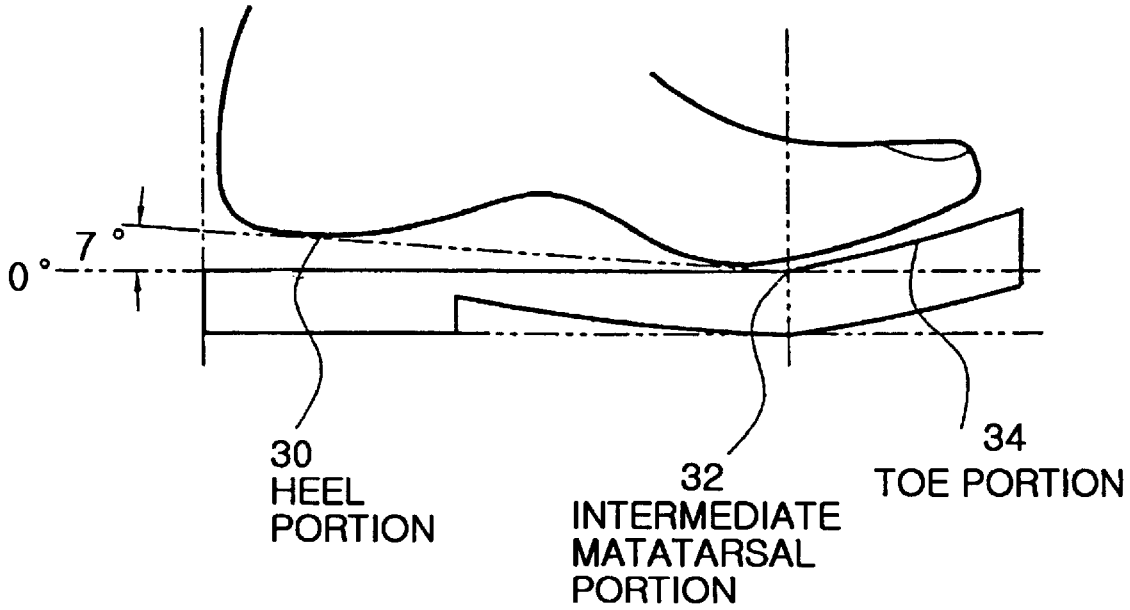
Figure 4:
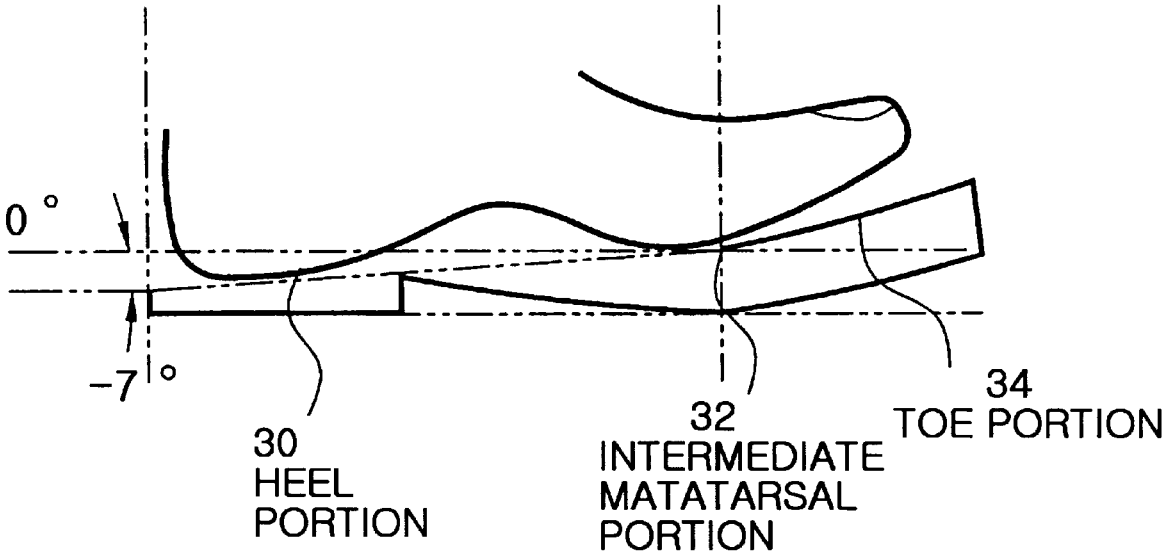
Figure 5:
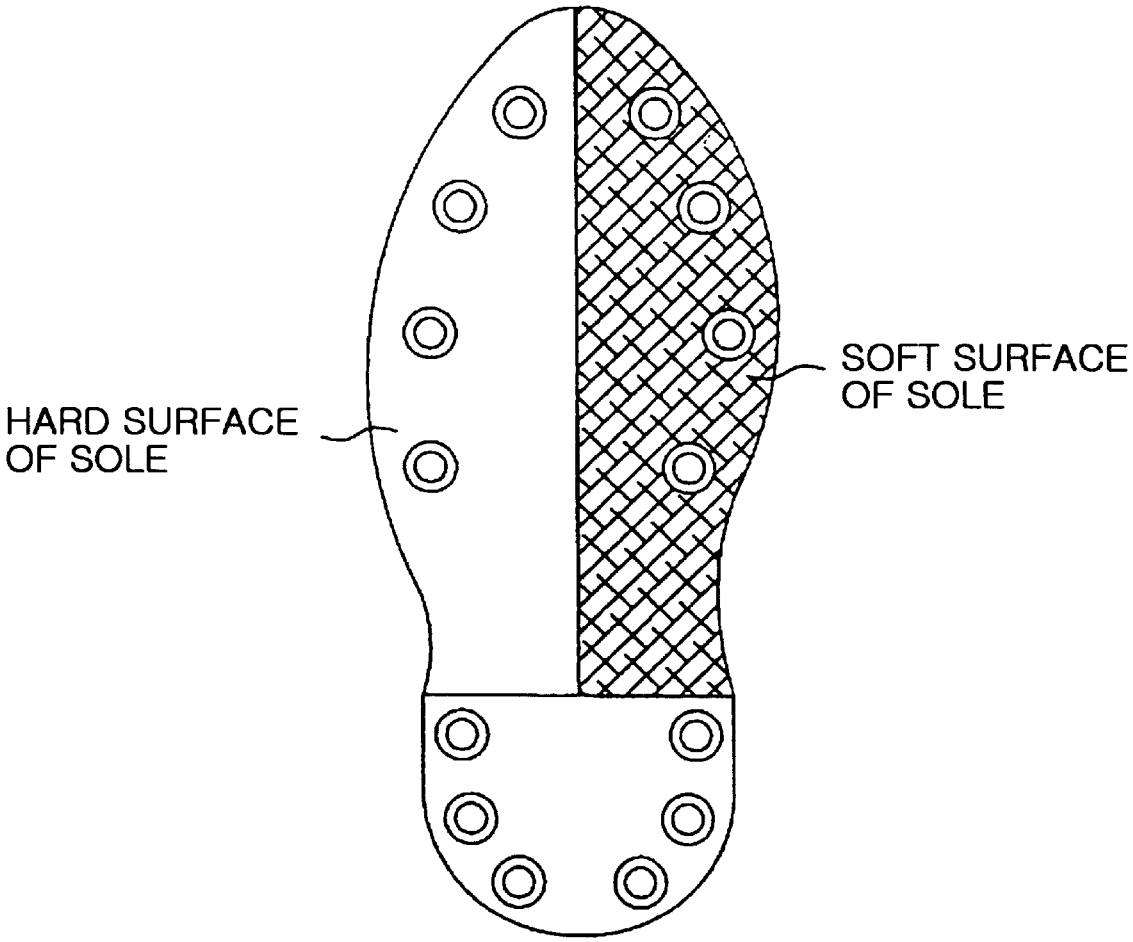
FIG. 5 is a plan view showing the sole or mid sole of the golf shoes according to the present invention.
Figure 6:
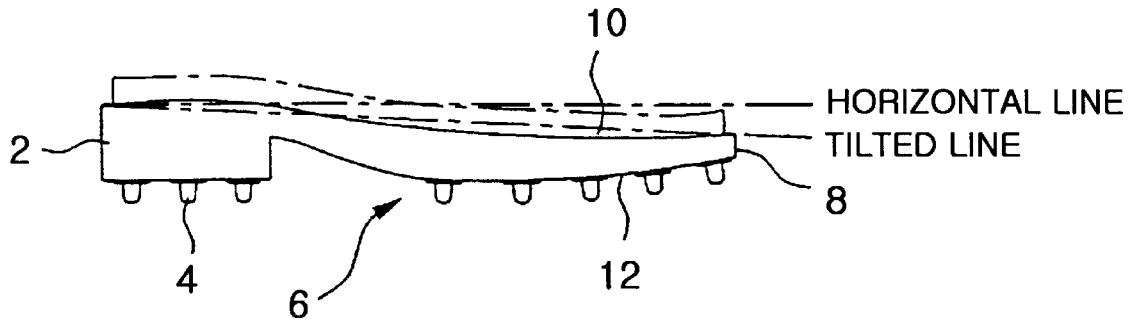
FIG. 6 is a cross sectional view illustrating the sole of a conventional golf shoe.
Figure 7:
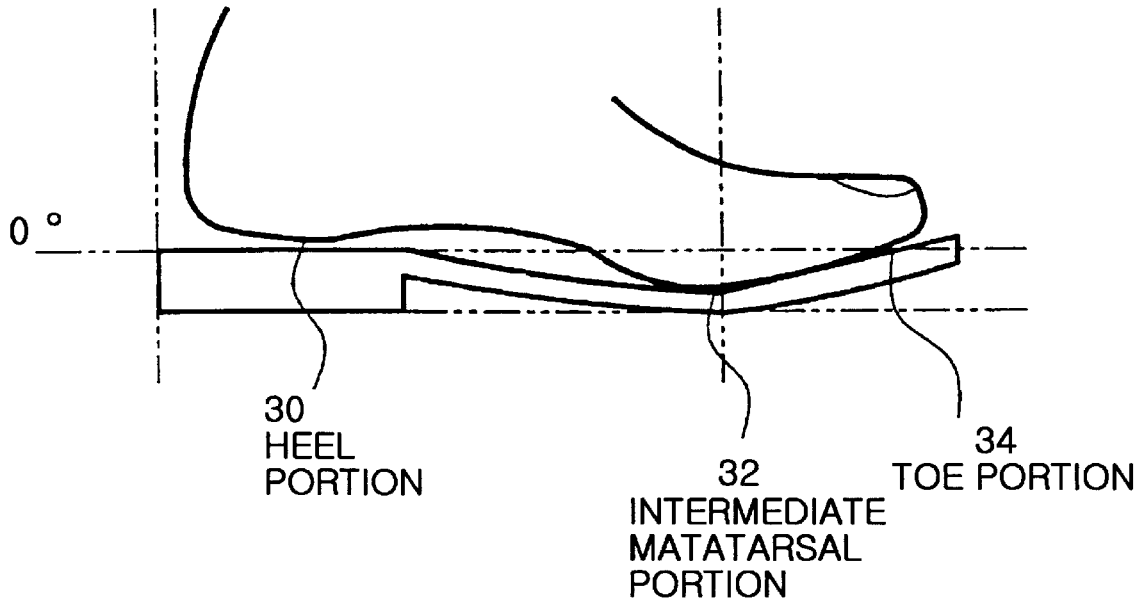
FIG. 7 PRIOR ART
FIG. 7 is a cross sectional view illustrating the tilted angle of the sole of a conventional golf shoe.

FIG. 2 to FIG. 4 represent the slope of the sole, and FIG. 5 is a plain view illustrating the sole or mid sole of the golf shoes of the present invention.

The sole of the golf shoes according to the present invention comprises an intermediate metatarsal portion formed between toe portion (34) and heel portion (30), and the highs of said toe portion (34), heel portion (30) and intermediate metatarsal portion (32) are curved so as to accompany the sole of a foot and toe portion (34) which is the front portion of the sole engaging said sole of a foot is tilted 1~5° upward from a horizontal line taking said intermediate metatarsal portion (32) as pivot point and said heel portion is tilted −7~7° from the horizontal line taking said intermediate metatarsal portion as pivot point. It is discovered that a golfer can perform stabilized swing while wearing the above-mentioned golf shoes.

More specifically, according to one embodiment of the golf shoes of the present invention as shown in FIG. 3, heel portion is tilted 7° from the horizontal line taking said intermediate metatarsal portion as pivot point and toe portion (34) is tilted 4° upward from the horizontal line taking said intermediate metatarsal portion (32) as pivot point.

When a golfer puts his foot in the golf shoes, said heel portion is gradually lowered to 0° from the horizontal line taking said intermediate metatarsal portion as pivot point and said toe portion (34) is tilted upward from the horizontal line taking said intermediate metatarsal portion (32) as pivot point in order to transfer the center of weight to the heel portion.

According to another embodiment as shown in FIG. 4, the heel portion is tilted downward 7° from horizontal line taking said intermediate metatarsal portion as pivot point and said toe portion (34) is tilted upward 4° from the horizontal line taking said intermediate metatarsal portion (32) as pivot point so that the center of weight is transferred to heel portion.

As described above, it is preferred that the toe portion (34) is tilted upward 1~5° from the horizontal line taking said intermediate metatarsal portion (32) as pivot point and the heel portion is tilted downward −7~7° from the horizontal line taking said intermediate metatarsal portion as pivot point.

When the heel portion is tilted 0° from the horizontal line taking said intermediate metatarsal portion as pivot point and the heel portion and intermediate metatarsal portion lie on the same plane and the toe portion (34) is tilted upward 1~5° from the horizontal line taking said intermediate metatarsal portion (32) as pivot point, it is the best way to provide the best stabilized stance in addressing.

That is to say, the center of the body weight is naturally transferred to the heel portion because the heel portion is tilted 0° from the horizontal line taking said intermediate metatarsal portion as pivot point and the toe portion (34) is tilted upward 4° from the horizontal line taking said intermediate metatarsal portion (32) as pivot point.

The height of the toe portion of the conventional golf shoes is formed to be about 11 mm or less from the ground. However, the height of toe portion of the present golf shoes is formed to be about 11 mm or more.

As described above, the center of weight is naturally transferred to the heel portion when the golfer put on the golf shoes and takes address stance because the toe portion (34) of sole is in a higher position than the heel portion (30). Therefore, it is not necessary for the golfer to move intentionally the center of his body weight to the heel portion when he takes address posture.

The golf shoes of the present invention have characteristics that they provide the golfer with a smooth swing because the center of weight is always in the heel portion (30) in an addressing stance. After the swing, the center of weight transferred to front part of left foot can be almost completely supported because the toe portion is in a higher position than the intermediate metatarsal portion of the golf shoes according to the present invention.

Since the toe portion (34) is higher than the heel portion (30) so that the heel portion of the sole touches the ground prior to the toe portion while walking. Therefore the fatigue can be reduced and the lower part of body can be strengthened naturally.

In yet another embodiment of the present invention as shown in FIG. 5, the golf shoes can be formed such that the inside surface and outside surface separated by a central longitudinal axis of the sole (or mid sole) are different from each other. The inside surface is soft surfaced and outside surface is hard surfaced, both of which are made from elastic materials. When a golfer puts his both feet together to take a stance for swing, the spikes fitted on the part of the soft surface are pressed down because they are fixed on soft surface. But spikes formed on the hard surface remain the same position so that the sole is tilted toward the soft surface. Therefore the pair of shoes facing each other can be easily tilted to the insides of the shoes.

Table 1 shows the result of a survey of 30 golfers using the golf shoes manufactured according to the present invention.

TABLE 1

| | Conventional golf shoes | Angle of heel Portion is −8° | Angle of heel Portion is −5° | Angle of heel Portion is 0° | Angle of heel Portion is 5° | Angle of heel Portion is 8° |
|---|---|---|---|---|---|---|
| Address | Good | Fairly good | Fairly good | Excellent | Fairly good | Unstable |
| Swing | Good | Fairly good | Fairly good | Excellent | Fairly good | Unstable |
| Finish | Good | Fairly good | Fairly good | Excellent | Fairly good | Unstable |
| Walk | Fairly good | Unstable | Good | Excellent | Excellent | Good |

According to the result of the survey for 6 types of classified golf shoes manufactured according to the present invention, 30 golfers evaluated golf shoes having an angle between the heel portion and horizontal line of −8° fairly as being good in address, swing and finish, but bad in walking.

Meanwhile, according to the present invention, when the angle between the heal portion and horizontal line is −5°, address, swing and finish are fairly good and walking is also good.

When the angle between the heel portion and horizontal line is 0°, address, swing, finish are excellent and walling is excellent, too.

When the angle between the heel portion and horizontal line is 5°, address, swing, finish are good and walking is fairly good.

Therefore, when the angle between the heel portion and horizontal line is 0°, the survey shows the best result.

But, when the angle between the heel portion and horizontal line is 8°, the feeling of wearing the shoes is as bad as conventional golf shoes.

Considering the survey results, when the angle between the heel portion and horizontal line is deviated from the range of −7 and 70°, stability is decreased. But when the angle between the heel portion and horizontal line is 0°, the survey shows the best results.

As described in the above, the golf shoes according to the present invention are helpful in strengthening the lower part of the body and in health because these shoes can help the golfer to maintain proper posture while walking.

As will be appreciated from the foregoing description, it will be apparent to those skilled in the art that various changes and modifications can be made without departing from the spirit of the present invention. Thus the scope of the invention is not limited to the foregoing description of the present embodiments and should be indicated by the appended claims.

What is claimed is:

1. A pair of golf shoes each shoe having a sole, each sole comprising:

a toe portion, an intermediate metatarsal portion and a heel portion;

said toe portion formed continuously raising to a tip from a bending point of said intermediate metatarsal portion;

said intermediate metatarsal portion formed between said heel portion and said toe portion;

wherein said toe portion is angled 1° to 50° upward at a bending portion of said intermediate metatarsal portion from a horizontal line, a surface of the sole between said bending point of said intermediate metatarsal portion and said heel portion is flat (0°), thereby enabling a golf player to attain stability by transferring a center of body weight to a center of the player's feet during a swing; and wherein the sole of said toe portion and said intermediate metatarsal portion excluding said heel portion is divided at a centerline in the longitudinal direction forming an outside sole surface of a first material and an inside sole surface of a second softer and more elastic material, wherein the second material on the inside sole surface of the golf shoes facilitates bending inward the player's legs to attain stability at address and swing.

2. A pair of golf shoes as set forth in claim 1, wherein said heel portion is angled at the bending point of said intermediate metatarsal portion, substantially ranged between −7° to 7° from the horizontal line.

3. A pair of golf shoes as set forth in claim 2, wherein said heel portion is angled at the bending point of said intermediate metatarsal portion, substantially ranged between −5° to 5° from the horizontal line.

4. A pair of golf shoes as set forth in claim 1, wherein said toe portion is angled at the bending point of said intermediate metatarsal portion, substantially 4° upward from the horizontal line.

* * * * *